US006830485B2

(12) United States Patent
Koehler et al.

(10) Patent No.: US 6,830,485 B2
(45) Date of Patent: Dec. 14, 2004

(54) ELECTRICAL CONNECTOR WITH A TERMINAL PIN STABILIZING PLATE

(75) Inventors: David F. Koehler, Lake Orion, MI (US); Joel A. Pittenger, Imlay City, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/372,064

(22) Filed: Feb. 21, 2003

(65) Prior Publication Data

US 2004/0166739 A1 Aug. 26, 2004

(51) Int. Cl.[7] ..... H01R 17/00

(52) U.S. Cl. ..... 439/660

(58) Field of Search ..... 439/660, 140, 439/141, 357

(56) References Cited

U.S. PATENT DOCUMENTS 5,501,606 A * 3/1996 Oda et al.

* cited by examiner

*Primary Examiner*—Ross Gushi
*Assistant Examiner*—Phuongchi Nguyen
(74) *Attorney, Agent, or Firm*—Stacey E. Caldwell

(57) ABSTRACT

An electrical connector assembly includes a first connector with a dielectric housing mounting a plurality of terminals having pin portions. A pin stabilizing plate has a plurality of apertures for receiving the pin portions and is movable from a protecting position generally at distal ends of the pin portions to a mating position spaced inwardly of the distal ends. A second connector is mateable with the first connector and is engageable with the pin stabilizing plate for moving the plate from its protecting position to its mating position in response to mating of the connectors. Complementary interengaging latches between the second electrical connector and the pin stabilizing plate move the plate back from its mating position to its protecting position in response to unmating of the connectors.

16 Claims, 4 Drawing Sheets

FIG. 3
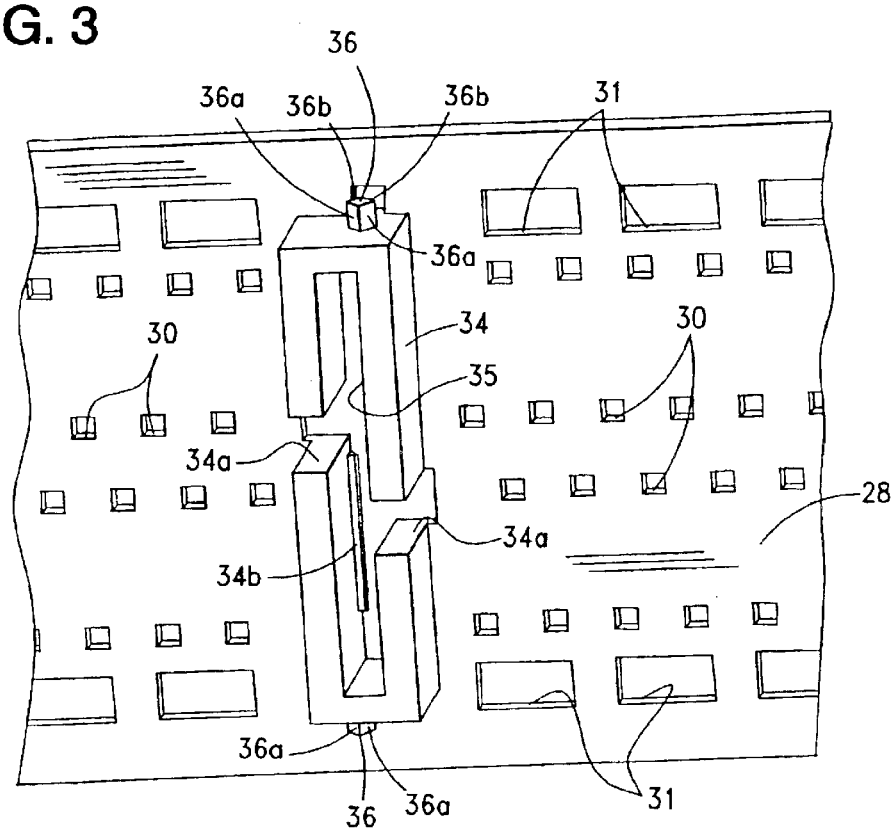
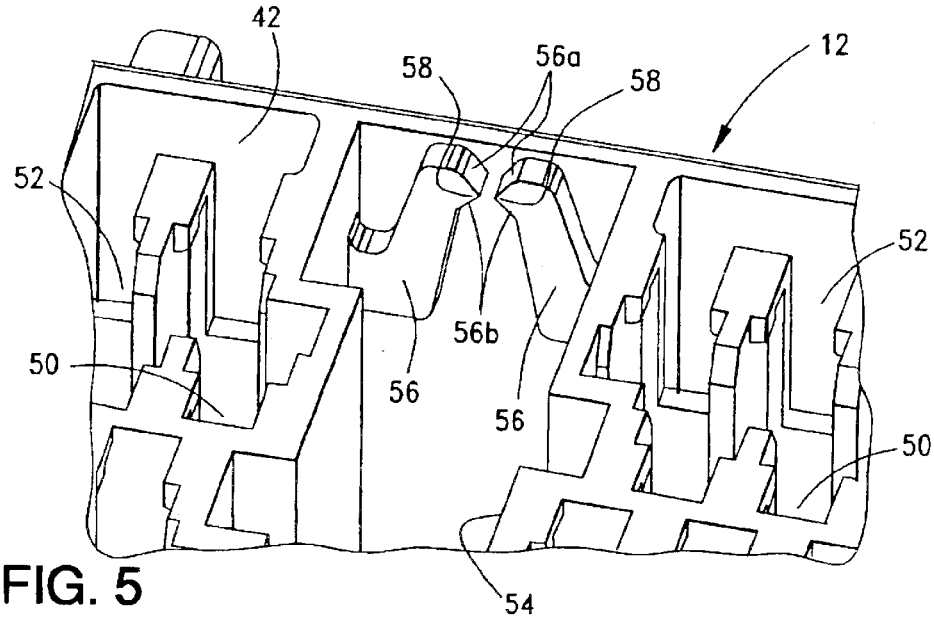
FIG. 5

ELECTRICAL CONNECTOR WITH A TERMINAL PIN STABILIZING PLATE

BACKGROUND OF THE INVENTION

This invention relates generally to the art of electrical connectors and, more particularly, to an electrical connector which has a terminal pin stabilizing plate that is movable between protecting and mating positions by a complementary mating connector.

Generally, an electrical connector typically includes an insulating or dielectric housing which mounts a plurality of conductive terminals having contact portions for engaging the terminals of a complementary mating connector. In many electrical connectors, the terminals have male, or pin, portions for engaging the terminals of the complementary mating connector. For instance, the mating connector will have female or receptacle terminals for receiving the pin portions of the terminals of the first connector. Unfortunately, problems are encountered in bending or otherwise damaging the terminal pin portions. This problem is magnified with the ever-increasing miniaturization of electrical connectors, whereby such terminal pin portions are very small components of the connector assembly.

Efforts have been made to provide protection for the pin portions of terminals as described above. For instance, pin alignment, or stabilizing, plates have been used, with such plates having a plurality of holes for receiving the terminal pin portions to maintain the alignment and spacing of the pin portions and prevent bending thereof or other damage thereto. The alignment or stabilizing plates may be removed or remain in place before the connector is mated, or it has been known to provide an arrangement whereby the mating connector moves the plate from an outer protecting position, inwardly along the pin portions to an inner mating position. Unfortunately, once the plate has been moved inwardly, the pin portions no longer are protected should the connectors be unmated. This creates problems in electrical connector assemblies wherein the respective connectors are used in applications that require cyclical mating and unmating of the respective connectors.

The present invention is directed to solving these problems by providing a connector and a connector assembly utilizing a pin stabilizing plate that is movably disposed on one of the connectors of the connector assembly and which is moved back and forth between protecting and mating positions in response to mating and unmating of a pair of connectors.

SUMMARY OF THE INVENTION

An object, therefore, of the invention is to provide an electrical connector assembly with a new and improved terminal pin stabilizing plate system.

In the exemplary embodiment of the invention, an electrical connector assembly includes a first electrical connector having a dielectric housing mounting a plurality of conductive terminals which have projecting, male pin portions. A stabilizing plate is provided that includes a plurality of apertures that receive the terminal pin portions. The stabilizing plate is movable from a protecting position generally at distal ends of the pin portions to a mating position spaced inwardly of the distal ends, in which the free ends of the terminal pin portions are exposed for mating with corresponding terminals of an opposing connector.

A second electrical connector is mateable with the first electrical connector and includes a mating portion for engaging the pin stabilizing plate and moving the plate rearwardly from its protecting position to its mating position in response to mating of the connectors. Complementary interengaging return means are provided between the second electrical connector and the pin stabilizing plate for moving the plate forwardly, back from its mating position to its protecting position in response to unmating of the connectors.

As disclosed herein, complementary interengaging stop means are provided between the first electrical connector and the pin stabilizing plate to prevent the plate from moving beyond its protecting position when the plate is moved back from its mating position to the protecting position. In the preferred embodiment, the stop means include abutting shoulders disposed on the first connector and on the pin stabilizing plate.

According to one principal aspect of the invention, the complementary interengaging return means may include a flexible latch arm disposed on one of either the second electrical connector or the pin stabilizing plate which is engageable with a latch boss disposed on one of the other of the second electrical connector or pin stabilizing plate. The flexible latch arm has a first angled surface for engaging and riding over the latch boss, whereby the latch arm will snap into locking engagement with the latch boss upon mating of the first and second connectors. The flexible latch arm further preferably has a second angled surface for engaging and riding over the latch boss upon unmating of the two connectors. A pair of the flexible latch arms are provided for engaging opposite sides of the latch boss, which latch boss is preferably diamond-shaped so as to define two pairs of angled surfaces that are engageable with the respective angled surfaces of the pair of flexible latch arms. Still further, in the preferred embodiment, two spaced-apart pairs of the flexible latch arms are provided on the second electrical connector, with a pair of spaced-apart bosses provided on the pin stabilizing plate.

According to another aspect of the invention, the connector housing of the first electrical connector includes an elongated guide wall located amidst the pin portions of the terminals and projecting in the same direction as the pin portions. The pin stabilizing plate includes an elongated opening embracing the elongated guide wall for guiding the plate in its movement between the protecting and mating positions.

Other objects, features and advantages of the invention will be apparent from the following detailed description taken in connection with the accompanying drawings.

BRIEF DESCRIPTION OF THE DRAWINGS

In the course of the following detailed description, reference will be frequently made to the accompanying drawings in which:

FIG. 3 is an enlarged perspective view of the center of the pin stabilizing plate;

DETAILED DESCRIPTION OF THE PREFERRED EMBODIMENT

Figure 1:
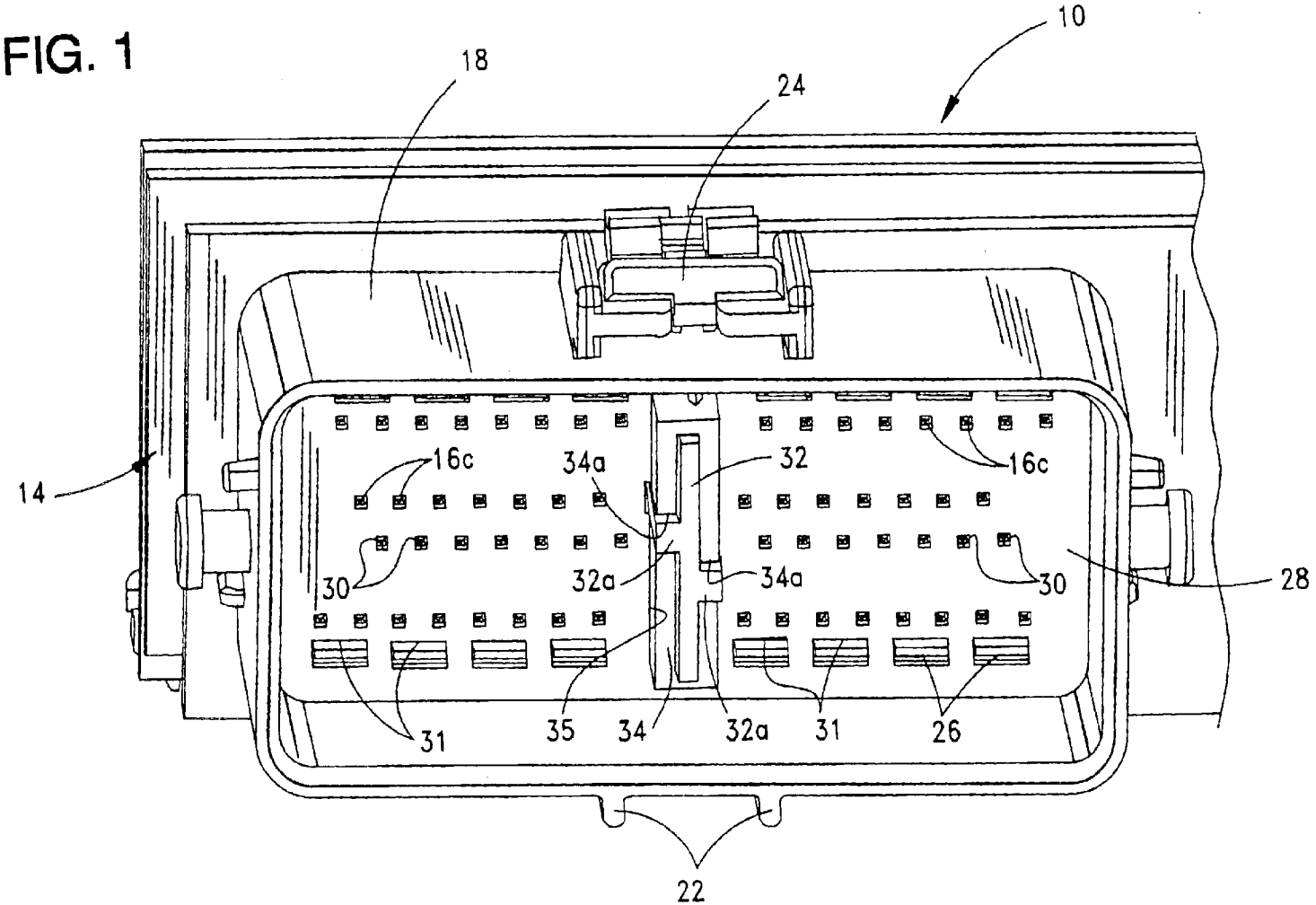
FIG. 1 is a perspective view looking at a first or header connector with the pin stabilizing plate in its protecting position.

Referring to the drawings in greater detail, and first to FIGS. 1 and 2, the invention is embodied in an electrical connector assembly which includes a first or header connector, generally designated 10, which is mateable with a second, or mating connector, generally designated 12 in FIG. 5 and described hereinafter. The header connector 10 includes a housing 14 formed from a dielectric material, to which is mounted a plurality of conductive terminals, generally designated 16 (FIG. 2). The housing is preferably unitarily molded of plastic material and has a shroud 18 which encircles and defines a mating area of the connector 10, and which projects forwardly in a mating direction. The conductive terminals 16 include male pin portions 16*a* that project from the housing 14 and are arranged within the shroud 18 as seen in FIG. 2. The terminals 16 have tail portions 16*b* which may project from the bottom of the housing 14 as illustrated, or which may extend from a rear face of the connector housing 14.

It should be understood that the invention is applicable for use in a wide variety of electrical connectors other than connectors 10 and 12 of the connector assembly shown in the drawings. Many configurations of electrical connectors have projecting terminal pins or pin portions which require protection and with which the unique pin stabilizing plate concepts of the invention are applicable.

With that understanding, the housing 14 of the header connector 10 includes a pair of mounting posts 20 or the like (FIG. 2) which assist in mounting the connector 10 onto a printed circuit board (not shown). Tail portions 16*b* of the terminals 16 are inserted into through holes in the printed circuit board for electrical connection to appropriate circuit traces on the board and/or in the through holes. A pair of polarizing ribs 22 may be disposed on the exterior of the connector 10 and are shown as projecting outwardly from one edge of the shroud 18 and they extend in the mating direction of the connector 10, for purposes described hereinafter. A latch structure 24 may project along the opposite edge of the shroud 18. A plurality of probes 26 extend forwardly in the same direction as pin portions 16*c*, for purposes to be described in greater detail hereinafter.

The invention herein is embodied in a unique pin stabilizing system which includes a pin stabilizing plate 28 that is located within the shroud 18 of the housing 14 and which is moveable along the male pin portions 16*a* of the terminals 16. The pin stabilizing plate 28 includes a plurality of apertures 30 disposed therein for receiving the terminal pin portions 16*a*. The pin stabilizing plate 28 also preferably includes a plurality of holes 31 through which the probes 26 freely extend. Basically, the pin stabilizing plate 28 is movable between two operative positions, one being an outer protecting position shown in FIG. 1 and the other position being an inner mating position shown in FIG. 2. In the outer protecting position of FIG. 1, the pin stabilizing plate 28 is located generally at the distal ends 16*c* of the terminal pin portions 16*a*. The pin stabilizing plate 28 is preferably molded, or otherwise formed from an electrically insulative material, such as a plastic.

Figure 2:
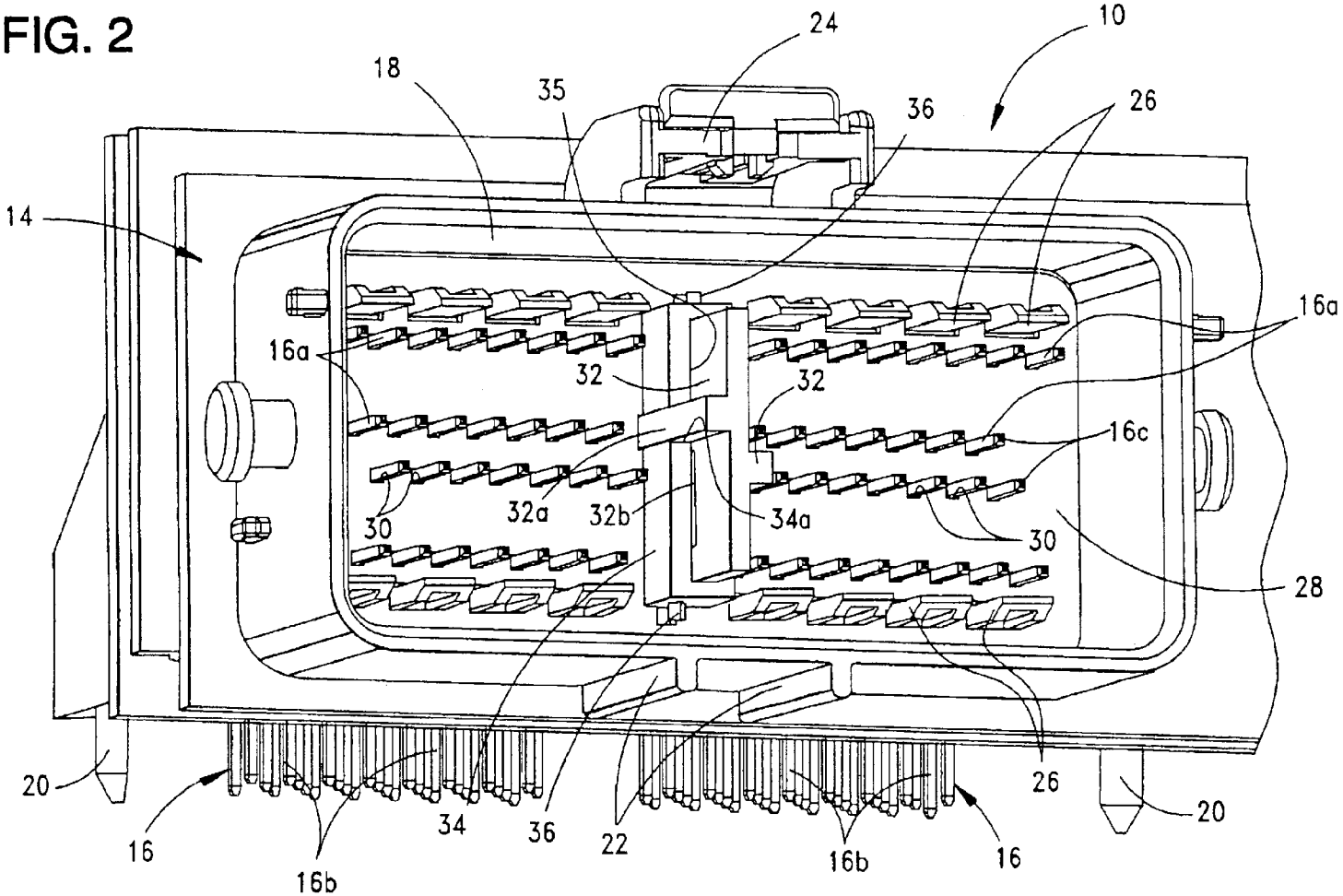
FIG. 2 is a perspective view of the header connector of FIG. 1 taken at a different angle and with the pin stabilizing plate in its mating position.

As seen best in FIGS. 1 and 2, an elongated planar guide wall 32 may be molded integrally with the housing 14 (or otherwise formed therewith) generally centrally amidst the terminal pin portions 16*a*. A pair of integral guide ribs 32*a* project outwardly from opposite sides of elongated guide wall 32 and extend in the direction of movement of the pin stabilizing plate. An elongated stop flange 32*b* (FIG. 2) projects outwardly the perimeter of the elongated guide wall 32.

Referring to FIG. 3 in conjunction with FIGS. 1 and 2, a generally rectangular, elongated guide wall 34 is formed as part of, and preferably molded integrally with the pin stabilizing plate 28 and projects at least partially outwardly therefrom. The rectangular guide wall defines an elongated opening 35 that extends vertically as shown in the drawings and which embraces the elongated planar guide wall 32 as seen in FIGS. 1 and 2, so that the pin stabilizing plate 28 can ride along the planar guide wall 34 between its protecting position (FIG. 1) and its mating position (FIG. 2). Of course, the planar guide wall 32 could be on the pin stabilizer plate and the rectangular guide wall 34 could be on the housing.

The rectangular guide wall 34 has a pair of slots 34*a* formed therein that receive the ribs 32*a* of the planar guide wall 32. An elongated stop flange 34*b* (FIG. 3) is disposed at each opposite side of opening 35 within the rectangular guide wall 34 for engaging stop flanges 32*b* (FIG. 2) of the planar guide wall 32 for purposes described hereinafter. Finally, an angularly configured and preferably diamond-shaped latch boss 36 is disposed at opposite ends of the elongated rectangular guide wall 34 and these bosses 36 project outwardly. Each latch boss preferably includes a pair of outwardly facing surfaces 36*a* and a pair of inwardly facing angled surfaces 36*b* defined thereon, again for purposes described hereinafter.

In assembly of the header connector 10, the pin stabilizing plate 28 first is assembled within the shroud 18 of the housing 14 before the conductive terminals 16 are mounted in the housing 14. The pin stabilizing plate 28 is then inserted into the shroud 18 by positioning the rectangular guide wall 34 of the stabilizing plate 28 over the planar guide wall 32 of the housing 14. The stabilizing plate 28 is pushed inwardly until stop flanges 34*b* (FIG. 3) on the inside of rectangular guide wall 34 ride over and "snap" behind stop flanges 32*b* (FIG. 2) on opposite sides of planar guide wall 32. The inner position of the pin stabilizing plate 28 corresponds to the mating position shown in FIG. 2 and is defined by the pin stabilizing plate 28 bottoming out against a bottom wall of the housing 14 within shroud 18. The bottom wall of the housing is not visible in the drawings because it is hidden behind the pin stabilizing plate as shown.

After the pin stabilizing plate is assembled as described above, the terminals 16 are appropriately mounted within the housing 14, and the terminal pin portions 16*a* are inserted through corresponding apertures 30 formed in the pin stabilizing plate 28. The stabilizing plate 28 then is pulled outwardly either manually or robotically to its protecting position shown in FIG. 1. This position is defined by the stop flanges 34*b* inside the rectangular guide wall 34 abutting against the stop flanges 32*b* on opposite sides of planar guide wall 32. The connector 10 now is ready for use and for mating with a complementary mating connector, such as mating connector 12 shown in FIG. 4.

Figure 4:
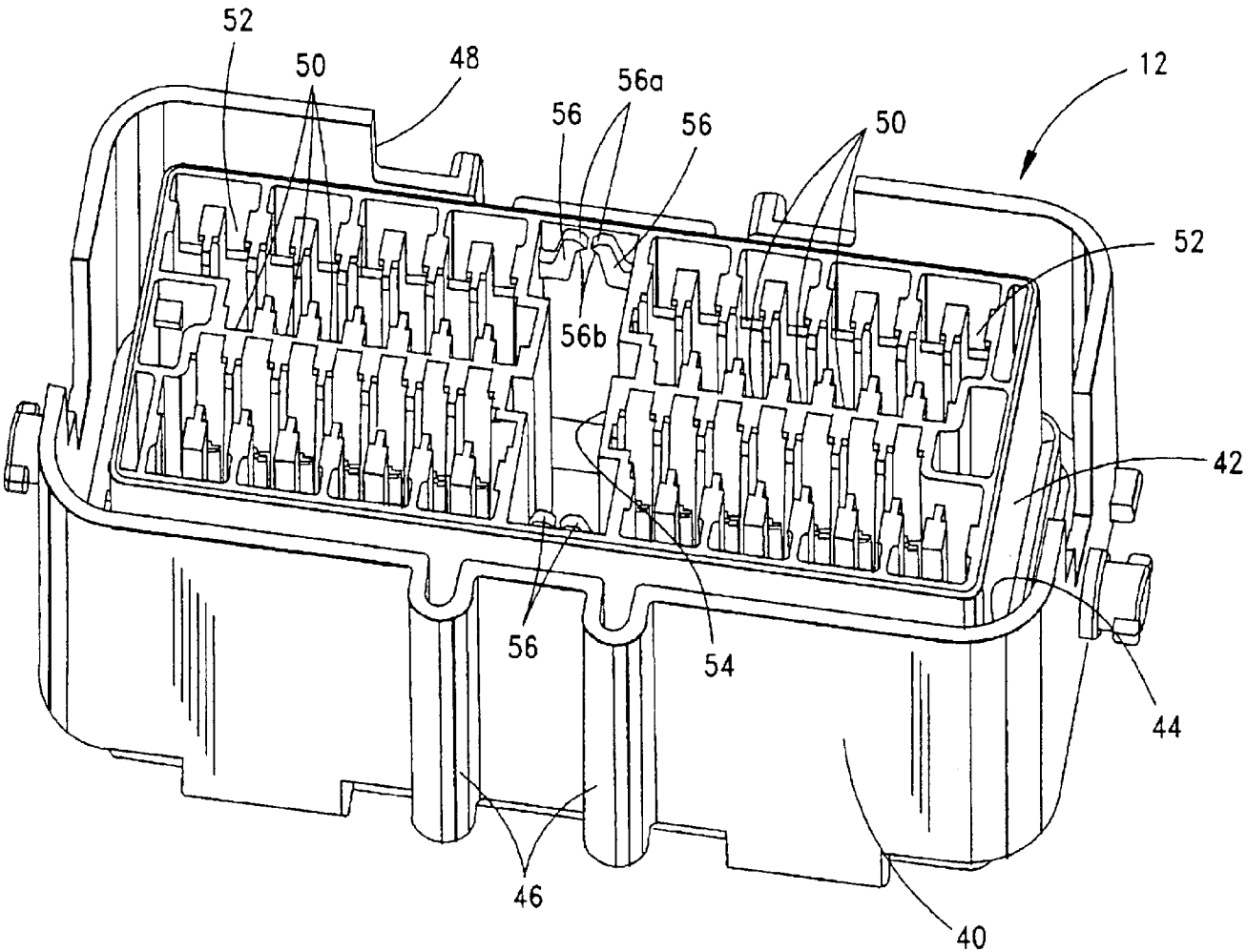
FIG. 4 is a perspective view of a second or mating connector which is mateable with the header connector of FIGS. 1 and 2; and, FIG. 5 is an enlarged perspective view of a center portion of the mating connector showing one of the pairs of flexible latch arms which engage the pin stabilizing plate of the header connector.

Referring now to FIG. 4, the mating connector 12 is shown to include an outer housing 40 having an inner plug portion 42. During mating of the two connectors 10 & 12, the shroud 18 of the header connector 10 moves into a groove 44 disposed between the outer housing 40 and the inner plug portion 42 of the mating connector 12, while the inner plug portion 42 is inserted into the shroud 18. Outer housing 40 of the mating connector 12 has a pair of polarizing channels 46 disposed on one side thereof for receiving the corresponding polarizing ribs 22 of the header connector 10. The opposite side of the outer housing 40 includes a cutout 48 for receiving the latch structure 24 of header connector 10. The latch structure 24 is engageable with a latch structure on the mating connector 12, but which is not visible in FIG. 4.

At this point, it should be explained that the inner plug portion 42 of the mating connector 12 includes a plurality of terminal-receiving passages 50 which receive a plurality of female or receptacle terminals that receive the terminal pin portions 16*a* of the header connector 10. In addition, the plug portion 42 includes a plurality of passages 52 formed therein which may support a plurality of shorting bars for engagement by probes 26 of the mating connector 10. The shorting bars and the female terminals are not shown in FIG. 4 because their presence would significantly clutter the depiction in FIG. 4, keeping in mind the above statements that the invention is applicable for use with a wide variety of different connector configurations.

With that understanding, referring to FIG. 5 in connection with FIG. 4, the plug portion 42 of the mating connector 12 includes a large central opening 54 which receives the planar guide wall 32 surrounded by rectangular guide wall 34 of the pin stabilizing plate 28 of the header connector 10. A pair of flexible latch arms 56 are molded integrally with the plug portion 42 at each opposite end of opening 54 for operative association with the latch bosses 36 at opposite ends of the rectangular guide wall 34 of the pin stabilizing plate 28.

Referring to FIG. 5 in conjunction with FIG. 3, the flexible latch arms 56 of each pair thereof define a pair of outwardly facing angled surfaces 56*a* for engaging angled surfaces 36*a* of one of the latch bosses 36. The pair of latch arms 56 have a pair of inwardly facing angled surfaces 56*b* for engaging the inwardly facing angled surfaces 36*b* of an opposing one of the latch bosses 36. Angled surfaces 56*a* and 56*b* of the flexible latch arms 56 are defined by opposite sides of opposing hook portions 58 of the latch arms 56.

The mating and unmating of connectors 10 and 12, along with the movement of pin stabilizing plate 28 in conjunction with the interengagement of the flexible latch arms 56 on the mating connector and latch bosses 36 on the pin stabilizing plate, now will be described. Mating connector 12 is mated with the header connector 10 by inserting the inner plug portion 42 of the mating connector into the shroud 18 of the header connector 10, with the pin stabilizing plate 28 in its protecting position as shown in FIG. 1 as described above. The angled surfaces 56*a* of the flexible latch arms 56 will engage the opposing angled surfaces 36*a* of latch bosses 36, moving the pin stabilizing plate 28 inwardly toward its mating position of FIG. 2. As the pin stabilizing plate 28 reaches its innermost mating position, the engagement of the angled surfaces 56*a* on the flexible latch arms 56 and the angled surfaces 36*a* on the latch bosses 36, will cause the flexible latch arms 56 to spread outwardly away from each other until the latch arms 56 pass the latch bosses 36, whereupon the latch arms 56 will resiliently "snap" back inwardly in place behind the latch bosses 36. The connectors 10, 12 now are fully mated, with the pin stabilizing plate 28 in its mated position shown in FIG. 2, and with pin portions 16 of terminal pins 16 inserted into the female terminals of mating connector 12.

During unmating, the angled surfaces 56*b* of the flexible latch arms 56 will engage the angled surfaces 36*b* of the latch arms 36 and pull the pin stabilizing plate 28 outwardly with the mating connector. In essence, those angled surfaces of the flexible latch arms 56 form complementary interengaging return means between the mating connector and the pin stabilizing plate for moving the pin stabilizing plate 28 back from its mating position to its protecting position automatically in response to unmating of the connectors.

Once the pin stabilizing plate 28 reaches its projecting position of FIG. 1, the stop flanges 34*b* (FIG. 3) on opposite sides of rectangular guide wall 34 of the pin stabilizing plate 28 engage the stop flanges 32*b* on opposite sides of the planar guide wall 32 of the header connector housing 14. These stop flanges 32*b* are effective to prevent any further outwardly movement of the pin stabilizing plate 28 beyond its protecting position of FIG. 1. Flexible latch arms 56 then will be forced outwardly by the engagement of angled surfaces 56*b* thereof with the angled surfaces 36*b* of the latch bosses 36, whereby the flexible latch arms 56 thereupon ride over the latch bosses 36 and the mating connector 12 can be unmated from its engagement with the header connector 10. In other words, the abutting resistive forces between stop flanges 32*b* and 34*b* are greater than the resistive forces between the flexible latch arms 56 and latch bosses 36. This can be easily determined by making the angle of angled surfaces 56*b* and 36*b* such that they are overcome by the resistive engagement forces between stop flanges 32*b* and 34*b*.

During movement of the pin stabilizing plate 28 between its protecting and mating positions, elongated planar guide wall 32 and elongated rectangular guide wall 34 are very effective to provide for smooth guiding movement of the pin stabilizing plate 28 without any binding thereof.

While the preferred embodiments of the invention have been shown and described, it will be apparent to those skilled in the art that changes and modifications may be made therein without departing from the spirit of the invention. For example, although the pin stabilizing plate 28 is shown in the preferred embodiments as having a center slot 35 that receives an rides upon the center guide wall 32, the connector housing 14 could be formed with the slot and the pin stabilizing plate could be formed with a guide wall that extends into the slot when the two connectors are fully mated. Additionally, one could utilize detents, bumps or other projections formed on the opposing (second) connector that would deflect over the angled surfaces of the latch bosses. Similarly, the pin stabilizing plate 28 may be held in its protecting position by a series of bumps. Accordingly, the scope of the invention is defined by the appended claims.

What is claimed is:

1. An electrical connector assembly, comprising:

a first electrical connector including a dielectric housing, a plurality of conductive terminals mounted in the housing and having pin portions projecting therefrom, a pin stabilizing plate having a plurality of apertures for receiving the pin portions of the terminals, said pin stabilizing plate being movable between two operative positions, the first such position being a protecting position wherein said pin stabilizing plate is disposed at distal ends of said pin portions and the second such position being a mating position wherein said pin stabilizing plate is spaced inwardly of said terminal pin portion distal ends;

a second electrical connector mateable with the first electrical connector and engageable with the pin stabilizing plate for moving the plate from the protecting position to its mating position in response to mating of the connectors; and, complementary interengaging return means between the second electrical connector and the pin stabilizing plate for moving said pin stabilizing plate back from the mating position to said protecting position in response to unmating of said first and second connectors, said complementary interengaging return means including a flexible latch arm disposed on said second electrical connector and which is engageable with a latch boss disposed on said pin stabilizing plate, said flexible latch arm being disposed inside a housing wall of the second electrical connector to protect the flexible latch arm from breakage.

2. The electrical connector assembly of claim 1, wherein one of the first connector housing or said pin stabilizing plate includes an elongated guide wall located amidst said terminal pin portions, the guide wall extending in the same direction as said terminal pin portions, and the other of first connector housing or said pin stabilizing plate includes an elongated guide wall for guiding said pin stabilizing plate in movement between said protecting and mating positions.

3. The electrical connector assembly of claim 1, further including complementary interengaging stop means between said first electrical connector and said pin stabilizing plate to prevent said pin stabilizing plate from moving beyond said protecting position when said pin stabilizing plate is moved back from said mating position to said protecting position.

4. The electrical connector assembly of claim 3, wherein said stop means comprise abutting shoulders disposed on said first electrical connector and said pin stabilizing plate.

5. The electrical connector assembly of claim 1, wherein said flexible latch arm has a first angled surface for engaging and riding over said latch boss, whereby said flexible latch arm can snap into locking engagement with said latch boss upon mating of said first and second connectors.

6. The electrical connector assembly of claim 5, wherein said flexible latch arm has a second angled surface for engaging and riding over said latch boss upon unmating of said first and second connectors.

7. The electrical connector assembly of claim 6, further including a pair of said flexible latch arms engageable with opposite sides of said latch boss.

8. The electrical connector assembly of claim 7, wherein said latch boss is shaped to define two pairs of angled surfaces which are engageable with the respective first and second angled surfaces of said pair of flexible latch arms.

9. The electrical connector assembly of claim 8, including two spaced apart pairs of said flexible latch arms on said second electrical connector engageable with a pair of spaced-apart bosses on said pin stabilizing plate.

10. An electrical connector assembly, comprising:

a first connector including a dielectric housing, a plurality of conductive terminals mounted in the housing and having pin portions projecting therefrom, a pin stabilizing plate having a plurality of apertures for receiving the pin portions of the terminals, said pin stabilizing plate being movable from a protecting position generally at distal ends of said pin portions to a mating position spaced inwardly of said distal ends;

a second connector mateable with the first connector and engageable with the pin stabilizing plate for moving the plate from the protecting position to the mating position in response to mating of the connectors;

a flexible latch arm on said second connector engageable with a latch boss on the pin stabilizing plate to define a complementary interengaging return means between the second connector and said pin stabilizing plate for moving said pin stabilizing plate back from said mating position to said protecting position in response to unmating of the connectors, said flexible latch arm being disposed inside a housing wall of the second electrical connector to protect the flexible latch arm from breakage; and complementary interengaging stop means between said first connector and said pin stabilizing plate to prevent said pin stabilizing plate from moving beyond said protecting position when said pin stabilizing plate is moved back from said mating position to said protecting position.

11. The electrical connector assembly of claim 10, wherein one of said first connector housing or said pin stabilizing plate includes an elongated guide wall located amidst said terminal pin portions and projecting in the same direction as said terminal pin portions, and the other of said housing or said pin stabilizing plate includes an elongated guide wall for guiding said pin stabilizing plate in movement between said protecting and mating positions.

12. The electrical connector assembly of claim 10, wherein said flexible latch arm has an oblique surface for engaging and riding over the latch boss whereby the latch arm can snap into locking engagement with the latch boss upon mating of said first and second connectors.

13. The electrical connector assembly of claim 12, wherein said flexible latch arm has a second oblique surface for engaging and riding over said latch boss upon unmating of the connectors.

14. The electrical connector assembly of claim 13, including a pair of said flexible latch arms engageable with opposite sides of said latch boss.

15. The electrical connector assembly of claim 14 wherein said latch boss is shaped to define two pairs of oblique surfaces engageable with the respective oblique surfaces of said pair of flexible latch arms.

16. The electrical connector assembly of claim 15, including two spaced apart pairs of said flexible latch arms on said second connector engageable with a pair of spaced apart bosses on said pin stabilizing plate.

* * * * *